US010328595B2

(12) United States Patent
Shin et al.

(10) Patent No.: US 10,328,595 B2
(45) Date of Patent: Jun. 25, 2019

(54) POST-PROCESSING APPARATUS

(71) Applicant: FUJI XEROX CO., LTD., Tokyo (JP)

(72) Inventors: Jeman Shin, Incheon (KR); Dukhyun Ko, Incheon (KR); Woong Lee, Incheon (KR)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 3 days.

(21) Appl. No.: 15/697,693

(22) Filed: Sep. 7, 2017

(65) Prior Publication Data

US 2018/0236680 A1 Aug. 23, 2018

(30) Foreign Application Priority Data

Feb. 23, 2017 (JP) ..... 2017-032139

(51) Int. Cl.

| | |
|---|---|
| ***B65H 37/04*** | (2006.01) |
| ***B65H 39/00*** | (2006.01) |
| ***B26D 7/01*** | (2006.01) |
| ***B26D 7/06*** | (2006.01) |
| ***G03G 15/00*** | (2006.01) |

(52) U.S. Cl.

CPC ..... *B26D 7/015* (2013.01); *B26D 7/0675* (2013.01); *G03G 15/6538* (2013.01); *B65H 37/04* (2013.01); *B65H 2301/3421* (2013.01); *B65H 2301/42266* (2013.01); *B65H 2801/27* (2013.01)

(58) Field of Classification Search

CPC ..... B65H 37/04; B65H 2301/42266; B65H 39/00; B65G 47/82; B65G 47/844

USPC ..... 198/457.03, 370.07, 370.08, 371.2, 698, 198/699.1, 699, 728, 731, 732, 733, 734; 270/58.12, 52.16, 52.29, 58.07, 58.08, 270/58.11, 58.17, 58.27; 271/233, 269, 271/271

See application file for complete search history.

(56) References Cited

U.S. PATENT DOCUMENTS

| | | | | |
|---|---|---|---|---|
| 7,172,194 | B2 * | 2/2007 | Terao | G03B 27/74 270/58.08 |
| 7,862,026 | B2 * | 1/2011 | Terao | B65H 29/52 270/52.16 |
| 9,132,981 | B2 * | 9/2015 | Lee | B65H 31/3054 |

FOREIGN PATENT DOCUMENTS

JP 2015-131716 A 7/2015

* cited by examiner

*Primary Examiner* — Thomas A Morrison
(74) *Attorney, Agent, or Firm* — Sughrue Mion, PLLC

(57) ABSTRACT

A post-processing apparatus includes a storing unit in which plural recording media are stored for performing post-processing, and a pushing member that latches onto and pushes trailing ends of the recording media stored in the storing unit toward an ejection port. When the number of the recording media stacked on the storing unit is small, the pushing member latches onto and pushes the trailing ends of the recording media at a position different from a position at which the pushing member latches onto and pushes the trailing ends of the recording media when the number of the recording media stacked on the storing unit is large.

4 Claims, 19 Drawing Sheets

POST-PROCESSING APPARATUS

CROSS-REFERENCE TO RELATED APPLICATIONS

This application is based on and claims priority under 35 USC 119 from Japanese Patent Application No. 2017-032139 filed Feb. 23, 2017.

BACKGROUND

(i) Technical Field

The present invention relates to a post-processing apparatus.

(ii) Related Art

In a post-processing apparatus that performs post-processing, such as stapling or punching, on a recording medium, such as a printing sheet, on which a printing operation has been performed, plural printing sheets on each of which post-processing is to be performed are stored in a storing unit called a compilation tray, and then the post-processing is performed on the stored printing sheets.

When ejecting a stack of printing sheets produced by performing post-processing, such as stapling, on plural printing sheets stored in the compilation tray, in order to eject the printing sheets stored in the compilation tray even in the case where the number of the printing sheets stored in the compilation tray is large, it is necessary to increase the height of a hook that latches onto trailing ends of the printing sheets. Thus, in the case where the number of the printing sheets to be ejected is small, for example, one, the probability of the trailing end of the printing sheet becoming caught in the hook increases.

SUMMARY

According to an aspect of the invention, there is provided a post-processing apparatus including a storing unit in which plural recording media are stored for performing post-processing, and a pushing member that latches onto and pushes trailing ends of the recording media stored in the storing unit toward an ejection port. When the number of the recording media stacked on the storing unit is small, the pushing member latches onto and pushes the trailing ends of the recording media at a position different from a position at which the pushing member latches onto and pushes the trailing ends of the recording media when the number of the recording media stacked on the storing unit is large.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail below with reference to the drawings.

Figure 1:
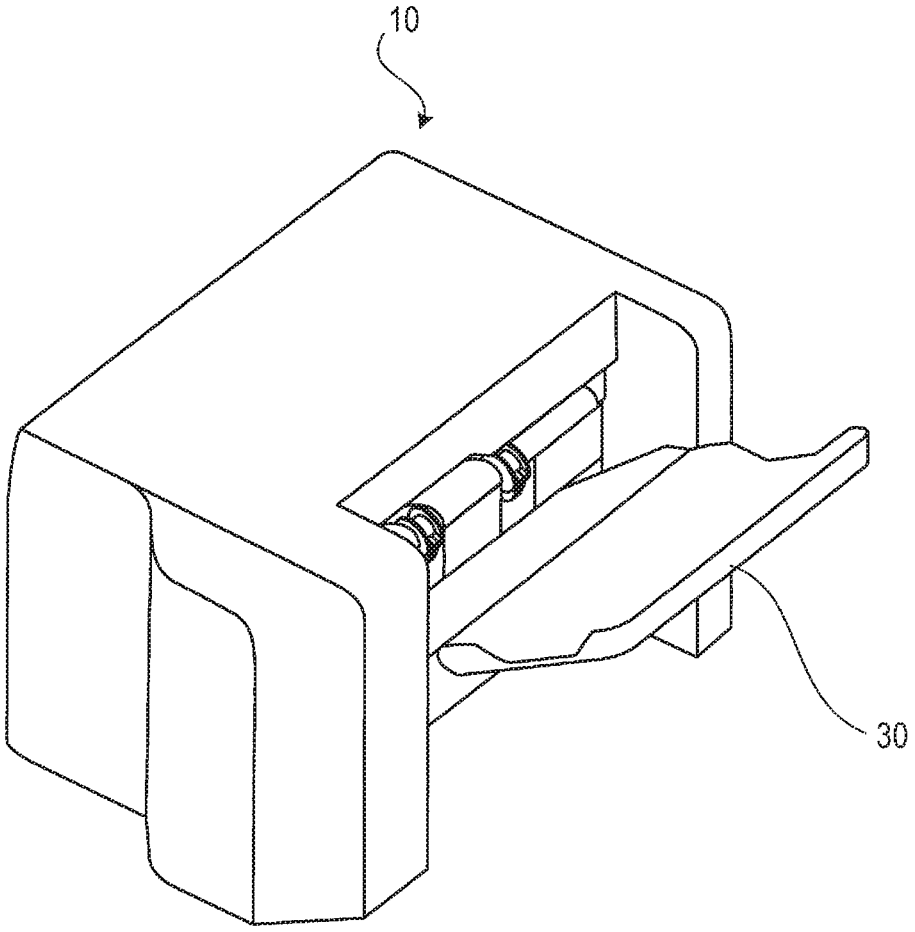
FIG. 1 is a perspective view illustrating the appearance of a post-processing apparatus according to an exemplary embodiment of the present invention.

FIG. 1 is a perspective view illustrating the appearance of a post-processing apparatus 10 according to an exemplary embodiment of the present invention.

As illustrated in FIG. 1, the post-processing apparatus 10 according to the exemplary embodiment of the present invention has a shape such that the post-processing apparatus 10 is used by being connected to a printer. The post-processing apparatus 10 has a function of performing post-processing, such as stapling, on plural printing sheets ejected from the printer and then ejecting a stack of the printing sheets, on which the post-processing has been performed to an ejection tray 30.

Figure 2:
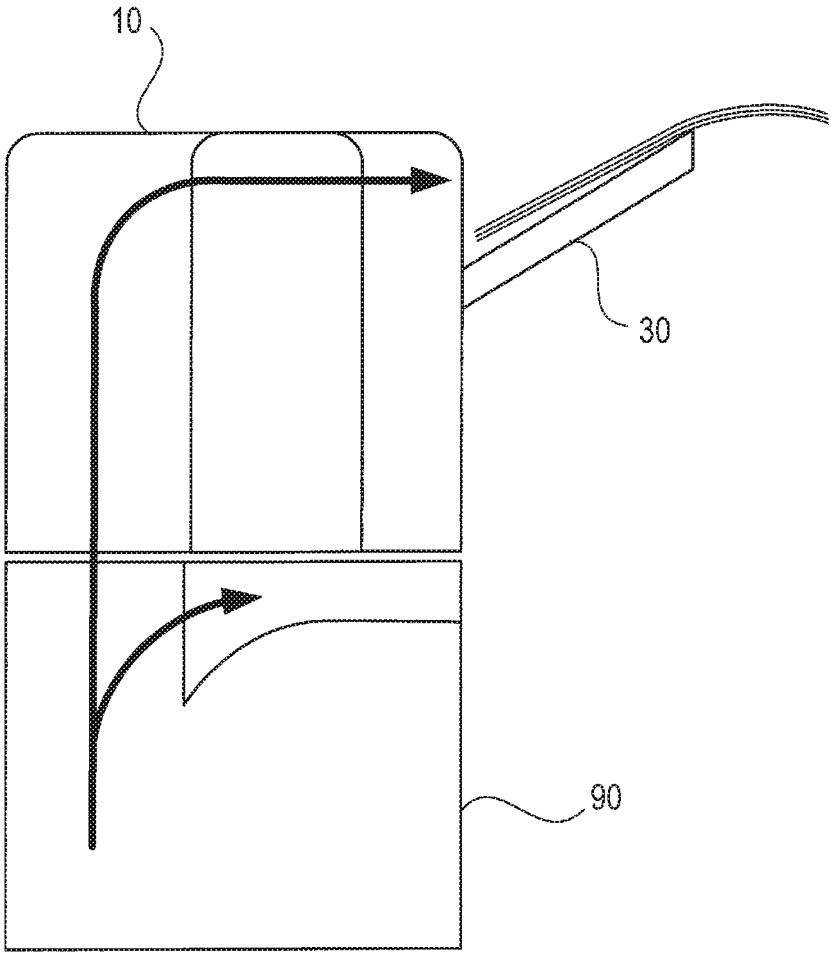
FIG. 2 is a diagram illustrating a state in which the post-processing apparatus according to the exemplary embodiment of the present invention is used by being connected to a printer.

A state in which the post-processing apparatus 10 is used by being connected to a printer 90 is illustrated in FIG. 2.

FIG. 2 illustrates a state in which the post-processing apparatus 10 ejects, to the ejection tray 30, a stack of printing sheets obtained by performing post-processing, such as stapling, on printing sheets that are ejected from the printer 90 and introduced into the post-processing apparatus 10.

The configuration of the post-processing apparatus 10 according to the present exemplary embodiment for performing post-processing on printing sheets and performing an ejecting operation that is to be performed after the post-processing will now be described.

Figure 3:
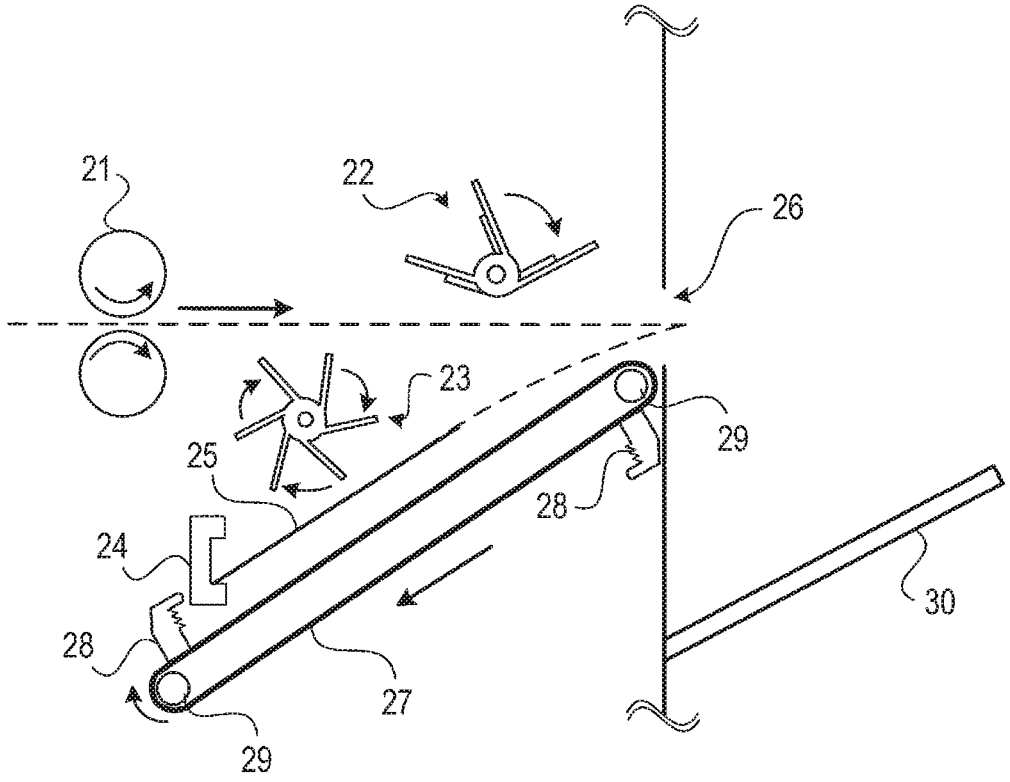
FIG. 3 is a schematic sectional view illustrating the configuration of a principal mechanism for performing post-processing in the post-processing apparatus according to the exemplary embodiment of the present invention.

FIG. 3 is a schematic sectional view illustrating the configuration of a principal mechanism for performing post-processing in the post-processing apparatus 10 according to the present exemplary embodiment. Note that FIG. 3 is a schematic sectional view illustrating an operation for ejecting a stack of printing sheets performed by the post-processing apparatus 10 and does not accurately illustrate the positional relationship in the actual configuration.

Referring to FIG. 3, the post-processing apparatus 10 according to the present exemplary embodiment includes transport rollers 21, sub-paddles 22, main paddles 23, an end guide 24, a compilation tray 25, an ejection port 26, ejection belts 27, stoppers 28, rotating rollers 29, and the ejection tray 30.

The transport rollers 21 transport printing sheets that are ejected from a printer or the like and on which post-processing is to be performed.

The compilation tray 25 is a storing unit in which plural printing sheets are stored for performing post-processing. Post-processing such as, for example, stapling or punching is performed on a stack of printing sheets stored in the compilation tray 25 by a post-processing mechanism (not illustrated).

The main paddles 23 and the sub-paddles 22 are each formed in such a manner as to have the shape of a paddle (blade) having flexibility and are transport members that transport the printing sheets in a given direction as a result of rotating.

The sub-paddles 22 transport one of the printing sheets transported from the upstream side of a transport path by the transport rollers 21 in a direction toward the compilation tray 25. More specifically, the sub-paddles 22 transport a recording medium, such as a printing sheet, to the compilation tray 25 as a result of rotating while being in contact with a surface of the recording medium.

Each of the sub-paddles 22 according to the present exemplary embodiment includes blades each of which comes into contact with one of the printing sheets and reinforcing portions each of which reinforces the strength of a portion of a corresponding one of the blades that does not come into contact with the printing sheet.

The main paddles 23 keep transporting one of the printing sheets transported by the sub-paddles 22 further toward the compilation tray 25 until an end of the printing sheet reaches the end guide 24.

The end guide 24 is a sheet-aligning unit used for aligning a trailing end of a stack of the printing sheets accommodated in the compilation tray 25.

A tamper (not illustrated) operates in accordance with the timing at which the printing sheets reach the end guide 24 such that alignment of a stack of the printing sheets on the compilation tray 25 in a width direction is performed.

Each of the ejection belts 27 is an endless belt member and is stretched between a corresponding two of the rotating rollers 29.

Each of the stoppers 28 is a hook member that latches onto a trailing end of a stack of printing sheets. A pair of the stoppers 28 are mounted on each of the ejection belts 27.

The ejection belts 27 are driven when ejecting a stack of printing sheets on which the post-processing has been performed. As a result of each of the ejection belts 27 being driven, the corresponding two stoppers 28 perform an operation for ejecting the stack of printing sheets, on which the post-processing has been performed in the compilation tray 25, from the ejection port 26 by moving while rotating by 180 degrees for each movement so as to hook and push the trailing end of the stack of printing sheets. The ejection belts 27 and the stoppers 28 function as pushing members that hook and push the trailing ends of the printing sheets stored in the compilation tray 25 toward the ejection port 26.

Figure 4:
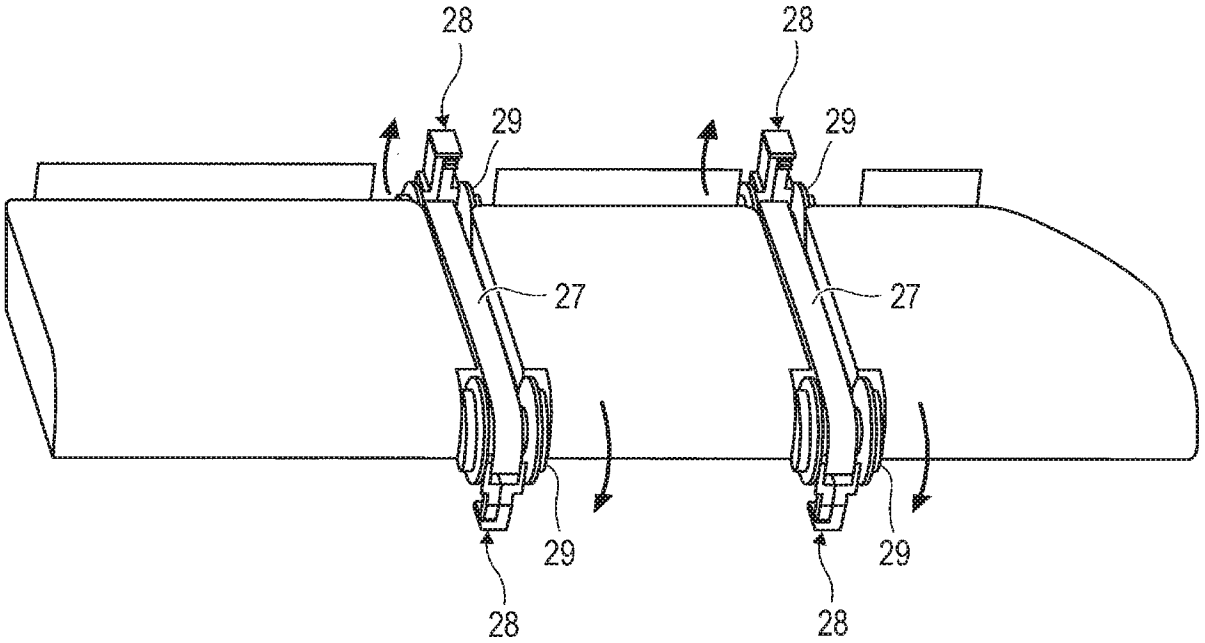
FIG. 4 is a perspective view illustrating the peripheral portion of stoppers in the post-processing apparatus according to the exemplary embodiment of the present invention.

The peripheral structure of the stoppers 28 in the post-processing apparatus 10 according to the present exemplary embodiment is illustrated in FIG. 4.

FIG. 4 illustrates the two ejection belts 27 on each of which the corresponding two stoppers 28 are mounted.

Referring to FIG. 4, one of the two rotating rollers 29, each of which is located on one end side of a corresponding one of the two ejection belts 27, is provided with a motor (not illustrated) serving as a driving source that drives the corresponding ejection belt 27 so that the corresponding ejection belt 27 rotates. When the motors are driven, the rotating rollers 29 are caused to rotate in such a manner that the two ejection belts 27 rotate at the same time and that the stoppers 28 move in parallel with each other.

Figure 5:
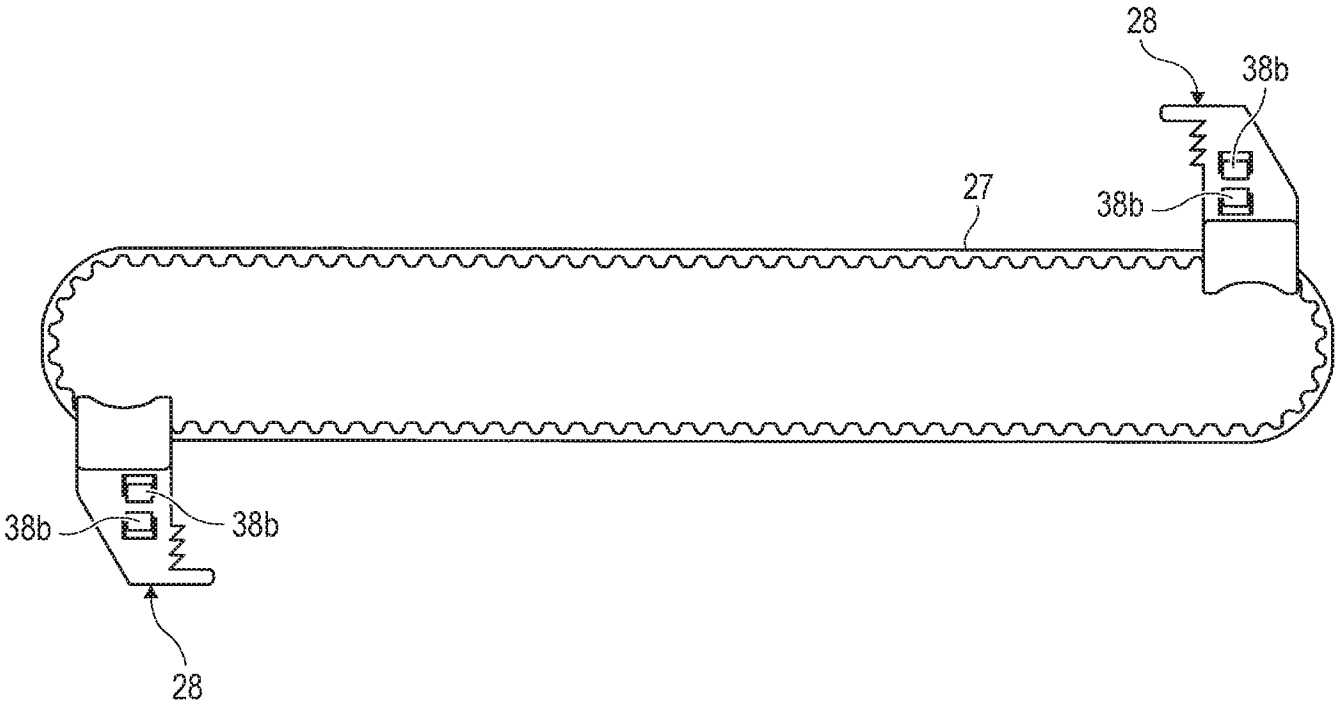
FIG. 5 is a diagram illustrating the state of the stoppers mounted on one of ejection belts in the configuration illustrated in FIG. 4.
Figure 6:
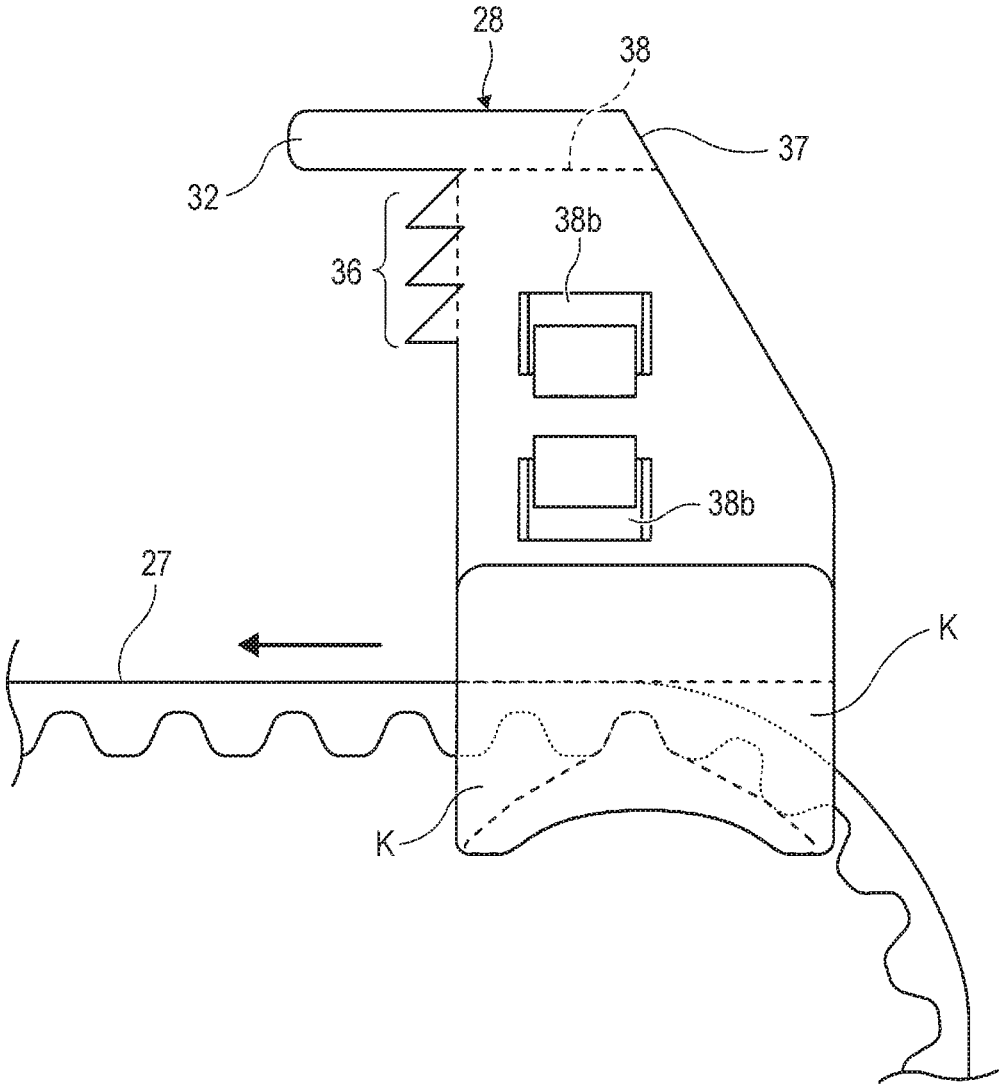
FIG. 6 is an enlarged view of one of the stoppers having the structure illustrated in FIG. 5.

FIG. 5 illustrates a state in which two of the stoppers 28 in the configuration illustrated in FIG. 4 are mounted on one of the ejection belts 27, and FIG. 6 is an enlarged view of one of the stoppers 28 having the structure illustrated in FIG. 5.

A hook 32 and a step portion 36 are formed on a surface of each of the stoppers 28, the surface facing a direction of movement of the stopper 28.

Each of the hooks 32 is formed at an end portion of the corresponding stopper 28 in such a manner as to project in the direction of movement of the stopper 28. The hook 32 functions as a first hook portion that latches onto the trailing end of a stack of a large number of printing sheets stacked on the compilation tray 25.

Each of the step portions 36 is formed in a sawtooth shape or a substantially sawtooth shape at a position closer to the corresponding ejection belt 27 than the corresponding hook 32 is when the stopper 28 is mounted on the ejection belt 27. The step portion 36 functions as a second hook portion that latches onto the trailing end of a stack of a small number of printing sheets stacked on the compilation tray 25. As a result of being formed in a sawtooth shape or a substantially sawtooth shape, the step portion 36 may easily latch onto the trailing end of a stack of printing sheets.

In other words, the hooks 32 or the step portions 36 are latched onto the trailing end of a stack of printing sheets in accordance with the number of the printing sheets on the compilation tray 25 and push the stack of printing sheets toward the ejection port 26.

Figure 7A:
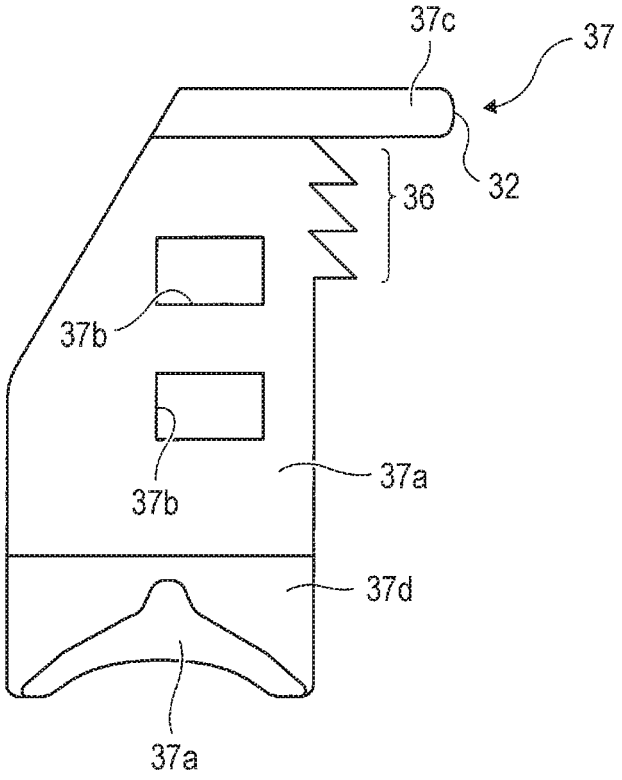
FIG. 7A and FIG. 7B are respectively a diagram illustrating a stopper body and a diagram illustrating a connecting member.
Figure 7B:
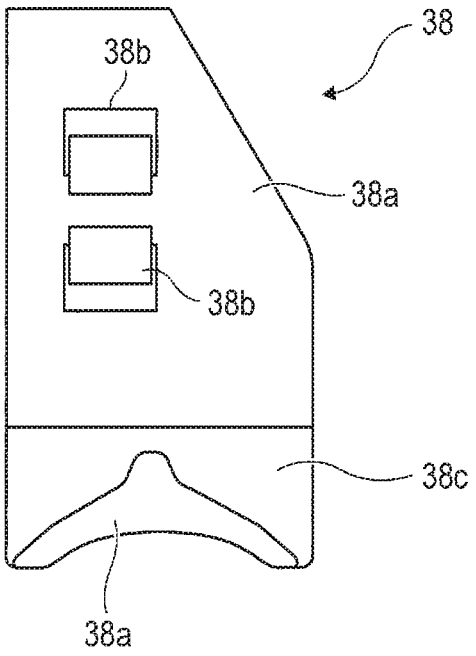

FIG. 7A and FIG. 7B are diagrams each illustrating an exploded state of one of the stoppers 28 having the structure illustrated in FIG. 6 that has been removed from the corresponding ejection belt 27. The stopper 28 includes a stopper body 37 and a connecting member 38 connected to the stopper body 37. FIG. 7A is a diagram illustrating a connecting surface of the stopper body 37 that is connected to the connecting member 38. FIG. 7B is a diagram illustrating a connecting surface of the connecting member 38 that is connected to the stopper body 37.

As illustrated in FIG. 7A, the stopper body 37 includes a body portion 37*a* that includes the step portion 36, two to-be-connected portions 37*b* each of which is cut out in a quadrangular shape, a projecting portion 37*c* that includes the hook 32 and projects from the body portion 37*a*, and a recess 37*d* that is formed in the body portion 37*a* by being recessed. One of the ejection belts 27 is mounted in the recess 37*d*. When the ejection belt 27 is mounted in the recess 37*d*, the outer peripheral surface of the recess 37*d* is formed so as to be straight. A center portion of the inner peripheral surface of the recess 37*d* is recessed in such a manner as to follow the shape of the ejection belt 27, and the inner peripheral surface is inclined from the center portion toward the end portions thereof to a larger extent than the shape of the ejection belt 27. The end portions of the recess 37*d* are formed by being recessed in such a manner as to be wider than the center portion of the recess 37*d*.

As illustrated in FIG. 7B, the connecting member 38 includes a body portion 38*a*, two connecting portions 38*b* that are to be connected to the two to-be-connected portions 37*b* of the stopper body 37, and a recess 38*c* formed in the body portion 38*a* by being recessed. One of the ejection belts 27 is mounted in the recess 38*c*. When the ejection belt 27 is mounted in the recess 38*c*, the outer peripheral surface of the recess 38*c* is formed so as to be straight. A center portion of the inner peripheral surface of the recess 38*c* is recessed in such a manner as to follow the shape of the ejection belt 27, and the inner peripheral surface is inclined from the center portion toward the end portions thereof to a larger extent than the shape of the ejection belts 27. The end portions of the recess 38*c* are formed by being recessed in such a manner as to be wider than the center portion of the recess 38*c*.

The end portions of the ejection belt 27 are fitted into the recess 37*d* of the stopper body 37 and the recess 38*c* of the connecting member 38 so as to be sandwiched between the stopper body 37 and the connecting member 38, and the connecting portions 38*b* of the connecting member 38 are mounted on and connected to the to-be-connected portions 37*b* of the stopper body 37.

When the stopper body 37 is mounted on the ejection belt 27, and the connecting member 38 is connected to the stopper body 37, for example, spaces K are formed between the ejection belt 27, the stopper body 37, and the connecting member 38 in a curved portion of the ejection belt 27 as illustrated in FIG. 6. Each of the spaces K functions as a curve-absorbing portion that absorbs the curve of the ejection belt 27. More specifically, a base portion of the stopper 28 on the rear side of the stopper 28 when the stopper 28 is brought into contact with the ejection belt 27 has a structure in which the spaces K absorb the curve of the ejection belt 27 such that the stopper 28 is connected to the ejection belt 27.

In other words, the stopper body 37 has a structure in which a load generated as a result of the stopper 28 being pulled by the ejection belt 27 when the stopper 28 passes across the curved portion of the ejection belt 27 is reduced by being connected to the connecting member 38 while the spaces K are formed therebetween, so that the stopper 28 smoothly passes across the curved portion of the ejection belt 27.

Each of the stoppers 28 according to the present exemplary embodiment is detachable from the corresponding ejection belt 27, and when the stopper 28 is required to be replaced due to deterioration thereof, the stopper 28 may be easily replaced. In addition, each of the stoppers 28 is capable of being mounted on a versatile belt member.

Each of the ejection belts 27 is formed of, for example, an elastic member made of an elastic rubber or the like, which is a material such as ethylene-propylene-diene rubber (EPDM) having a high elastic limit and a low modulus of elasticity. The stopper bodies 37 and the connecting members 38 are each formed of, for example, a member made of a resin.

The operation of the post-processing apparatus 10 according to the present exemplary embodiment will now be described with reference to FIG. 8 to FIG. 15.

Figure 8:
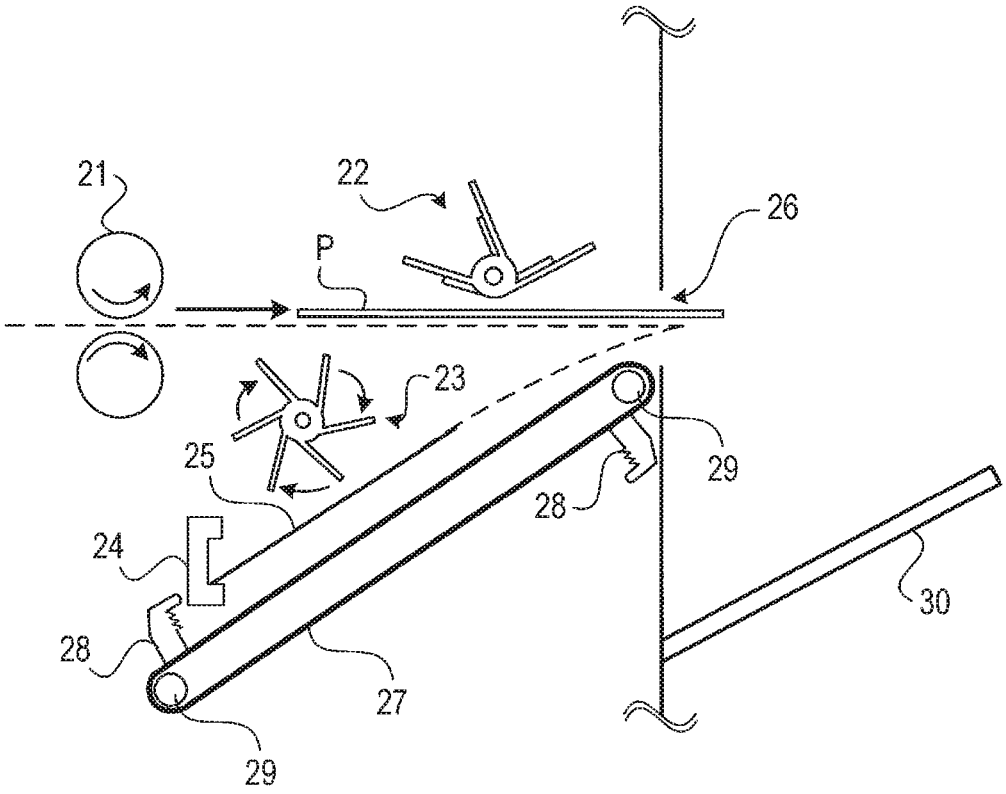
FIG. 8 is a diagram illustrating the operation of the post-processing apparatus according to the exemplary embodiment of the present invention.

First, in an initial state, the blades of the sub-paddles 22 are stationary at positions where the blades face away from a sheet transport path as illustrated in FIG. 8.

Figure 9:
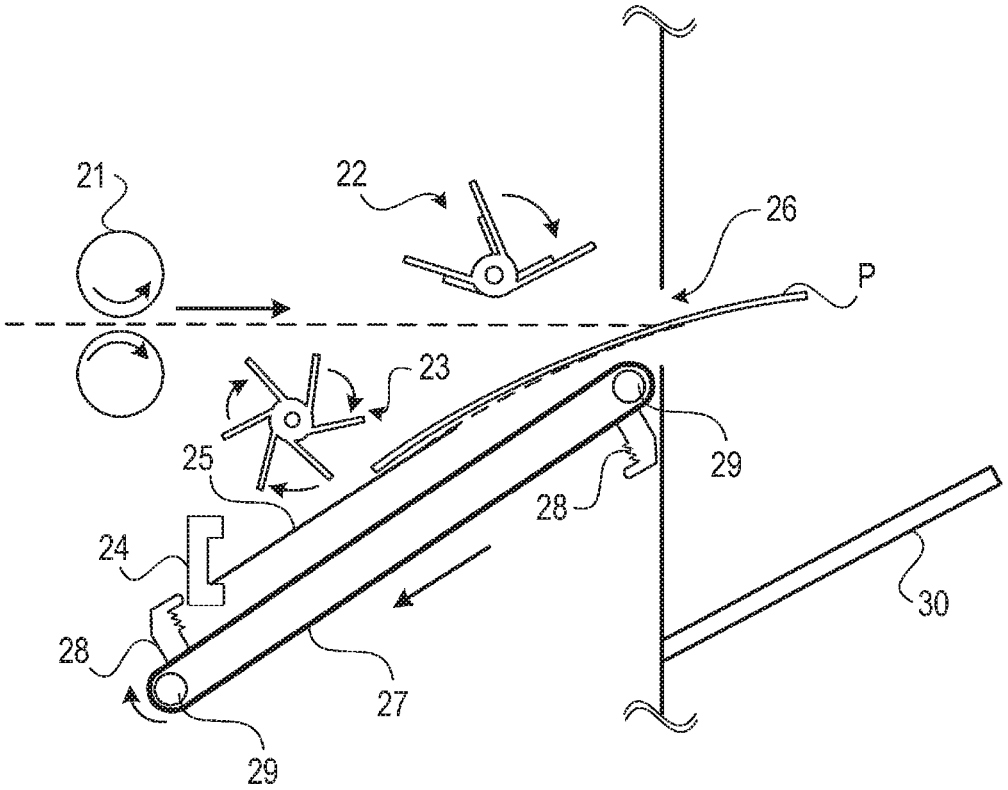
FIG. 9 is a diagram illustrating the operation of the post-processing apparatus according to the exemplary embodiment of the present invention.

Thus, as illustrated in FIG. 9, a printing sheet P transported by the transport rollers 21 passes under the sub-paddles 22 without being hindered and then stops.

Figure 10:
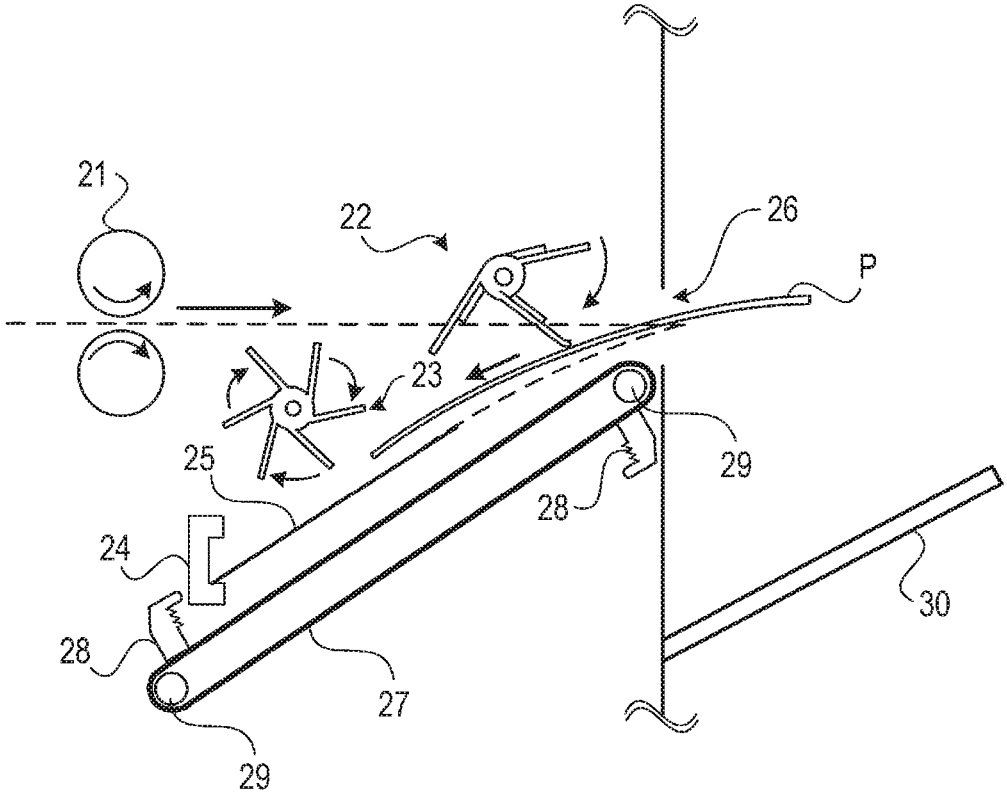
FIG. 10 is a diagram illustrating the operation of the post-processing apparatus according to the exemplary embodiment of the present invention.

In the state illustrated in FIG. 9, when power is supplied to the motors so as to cause the sub-paddles 22 to start rotating, as illustrated in FIG. 10, the blades of the sub-paddles 22 are brought into contact with the printing sheet P, and the printing sheet P is transported in the direction toward the compilation tray 25.

Figure 11:
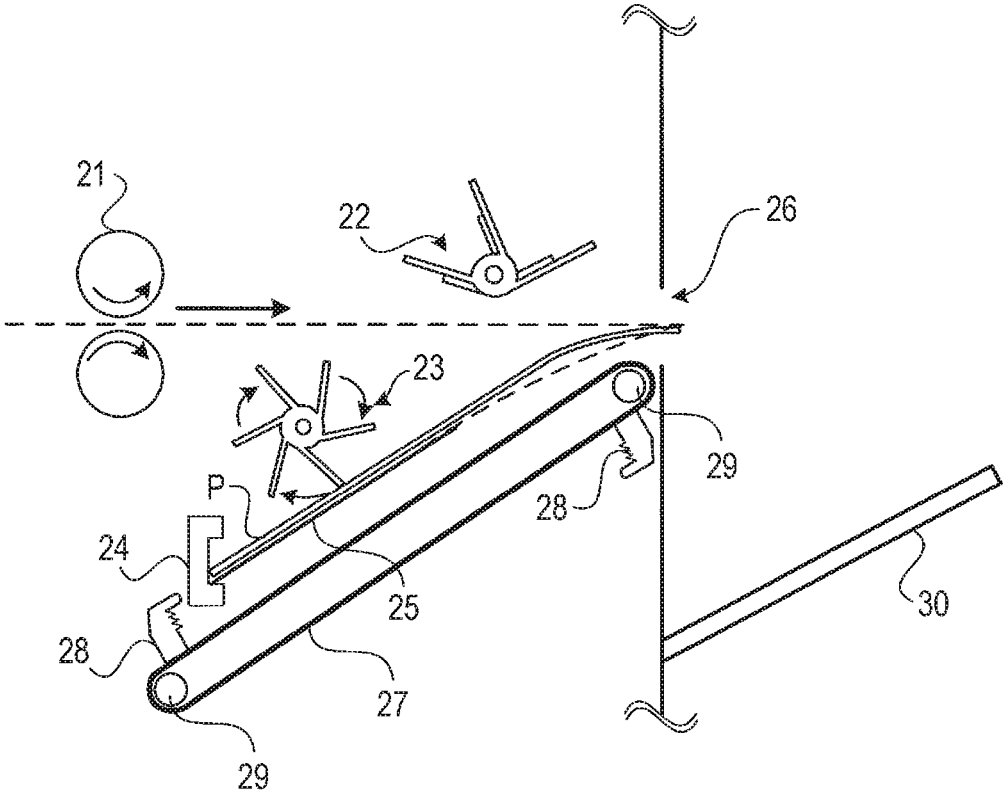
FIG. 11 is a diagram illustrating the operation of the post-processing apparatus according to the exemplary embodiment of the present invention.

Then, as illustrated in FIG. 11, the printing sheet P is brought into contact with the main paddles 23 and transported by the main paddles 23 until the printing sheet P abuts against the end guide 24.

Figure 12:
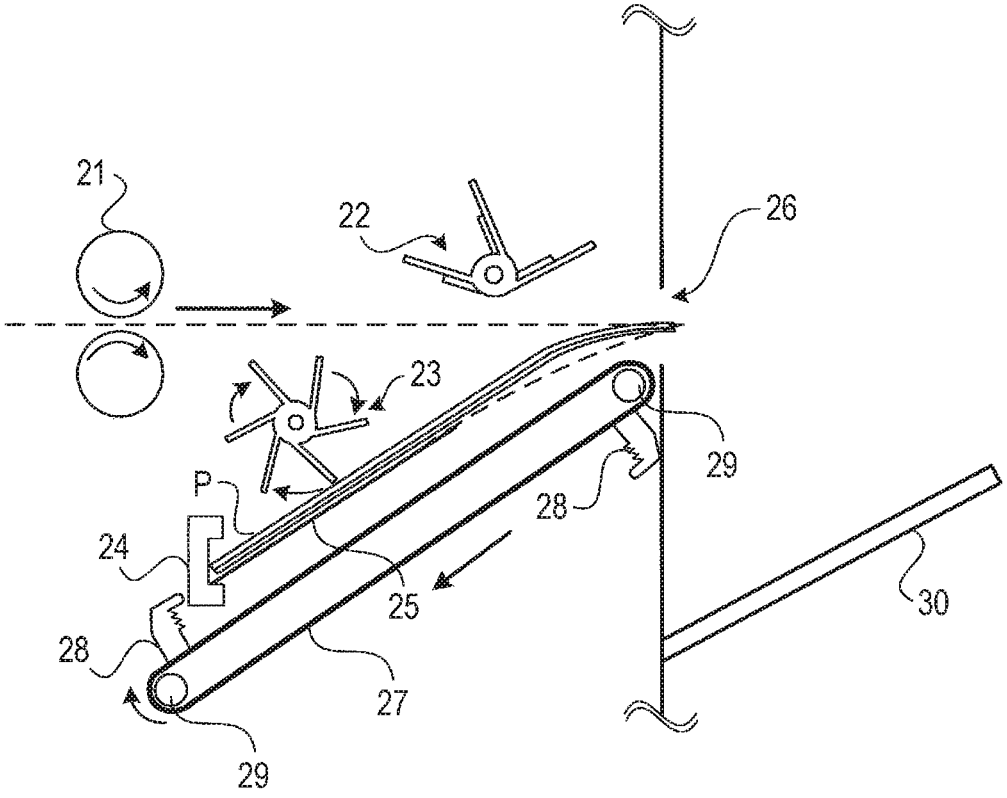
FIG. 12 is a diagram illustrating the operation of the post-processing apparatus according to the exemplary embodiment of the present invention.

Subsequently, when the next printing sheet P is transported by the transport rollers 21, an operation similar to the above is performed, and as a result, the plural printing sheets P are accommodated and stacked one on top of the other in the compilation tray 25 as illustrated in FIG. 12.

When a predetermined number of printing sheets P are accommodated in the compilation tray 25 by repeating such control, post-processing is performed on a stack of the printing sheets P.

Figure 13:
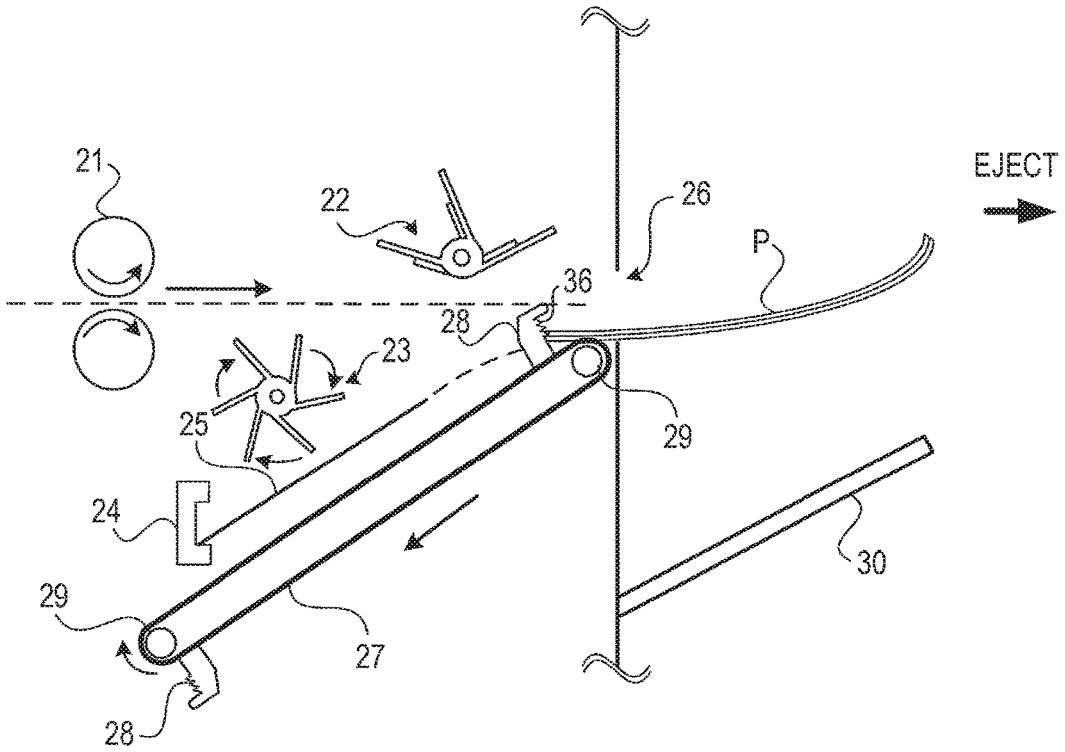
FIG. 13 is a diagram illustrating the operation of the post-processing apparatus according to the exemplary embodiment of the present invention.
Figure 14:
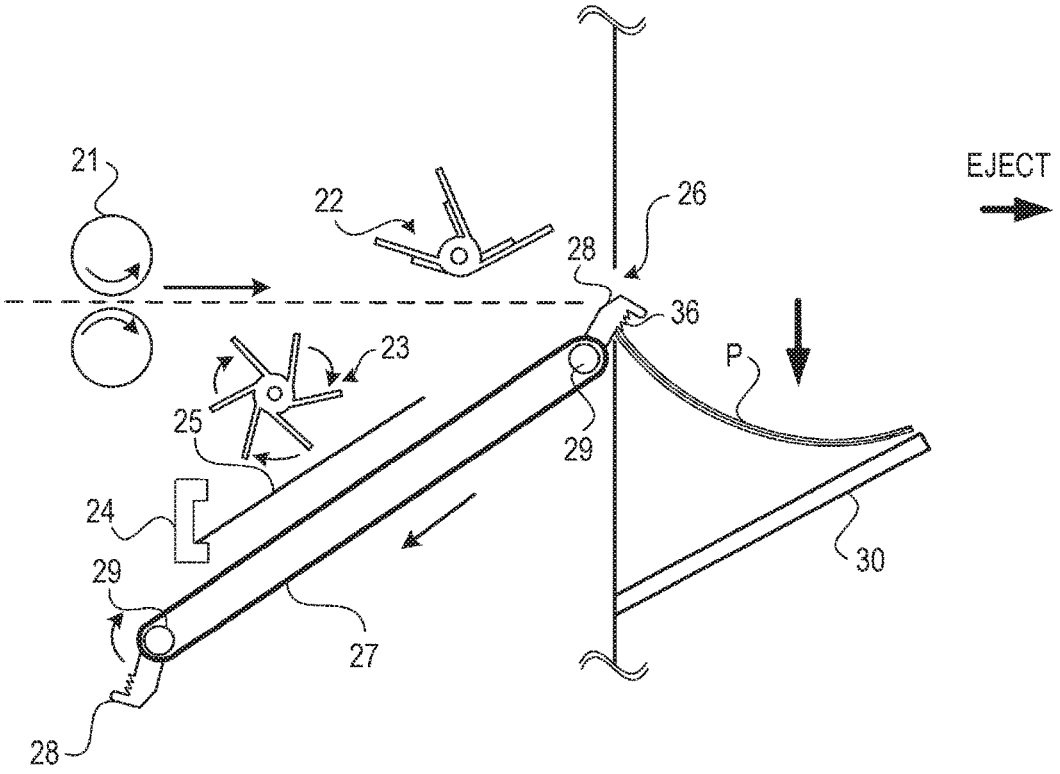
FIG. 14 is a diagram illustrating the operation of the post-processing apparatus according to the exemplary embodiment of the present invention.
Figure 15:
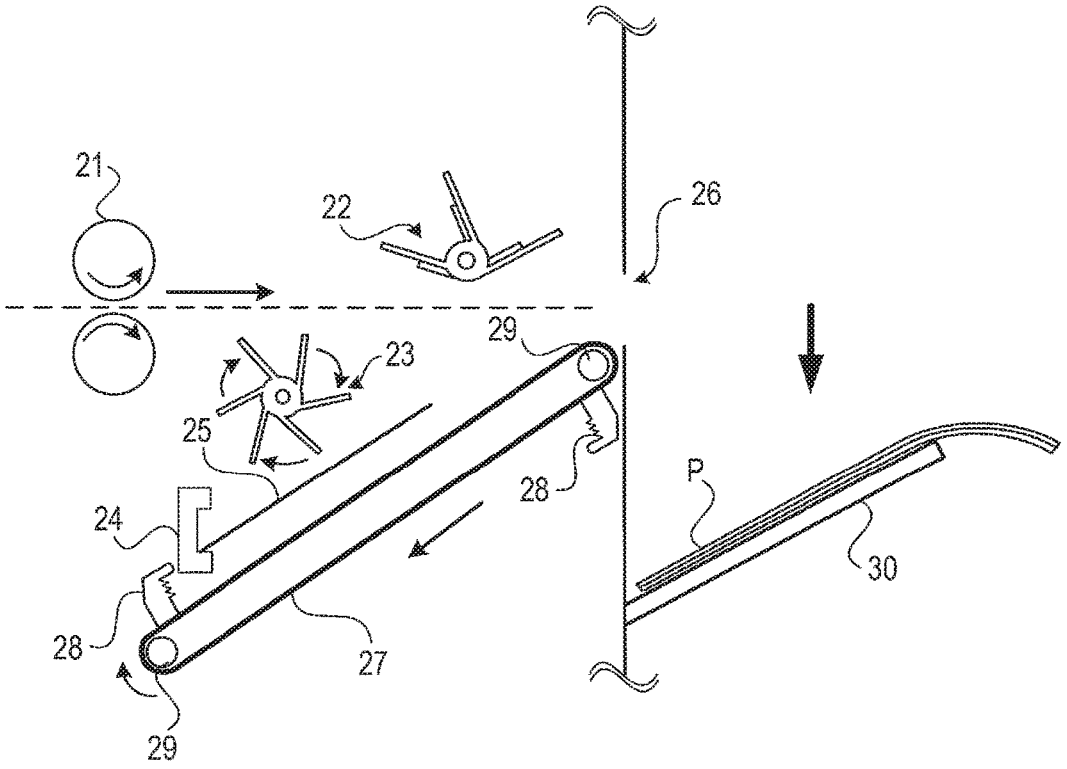
FIG. 15 is a diagram illustrating the operation of the post-processing apparatus according to the exemplary embodiment of the present invention.

When the stack of the printing sheets P, on which the post-processing has been performed, is ejected from the ejection port 26, as illustrated in FIG. 13, the motors are brought into a non-operating state, and each of the sub-paddles 22 is caused, by a spring, to stop at a stop position at which the sub-paddle 22 does not hinder the passage of the printing sheets P. In this state, when each of the ejection belts 27 is driven by a driving source (not illustrated), as illustrated in FIG. 13 and FIG. 14, the step portions 36 of the stoppers 28 latch onto and push the trailing end of the stack of the printing sheets P such that the stack of the printing sheets P is ejected from the ejection port 26. As a result, as illustrated in FIG. 15, the stack of the printing sheets P, which has been ejected, falls onto the ejection tray 30.

By performing control such as that described above, a stack of printing sheets obtained by performing the post-processing on plural printing sheets, on each of which a printing operation has been performed, is ejected to the ejection tray 30.

Figure 16:
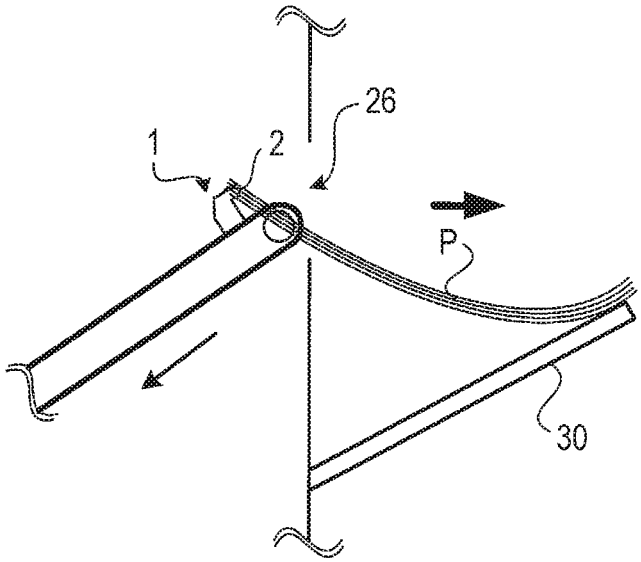
FIG. 16 is a diagram illustrating the operation of a post-processing apparatus according to a comparative example.
Figure 17:
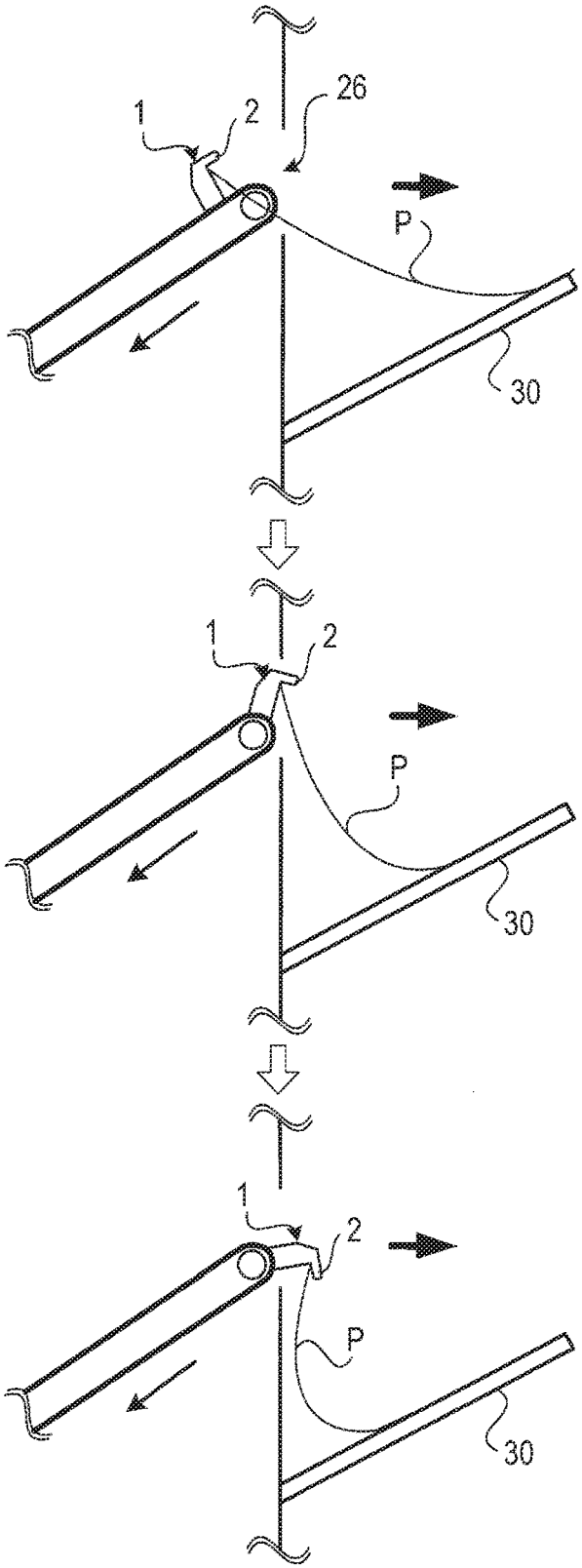
FIG. 17 is a diagram illustrating the operation of the post-processing apparatus according to the comparative example.

FIG. 16 and FIG. 17 illustrate an example in which a stopper 1 that employs a belt-ejection system and that does not include the step portion 36 is used. The stopper 1 includes a hook 2 that latches onto the trailing end of a stack of printing sheets.

Modifications of the stoppers 28, which have been described above, will now be described with reference to FIG. 18 and FIG. 19.

Figure 18:
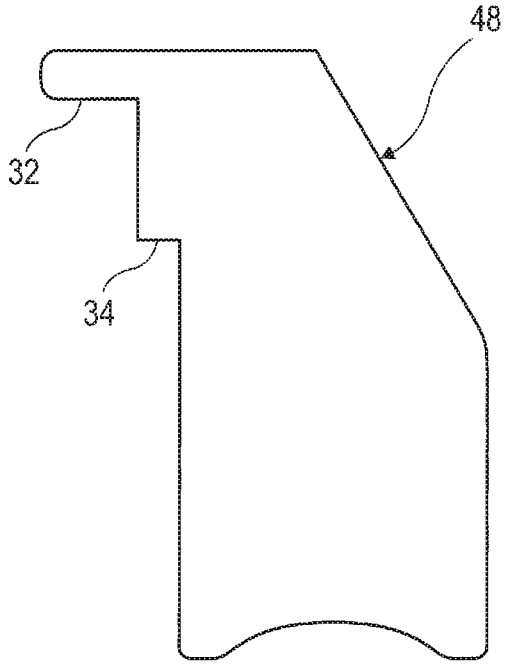
FIG. 18 is a diagram illustrating a modification of the stoppers.

As illustrated in FIG. 18, a stopper 48 according to one of the modifications includes the hook 32, which is included in each of the above-described stoppers 28, and a step portion 34 having a step-like shape or a substantially step-like shape. Also in the stopper 48 according to the present modification, in the case where the number of printing sheets stacked on the compilation tray 25 is large, a surface that is located on the inner surface side of the hook 32 and is located between the hook 32 and the step portion 34 latches onto an end portion of a stack of the printing sheets, and in the case where the number of the printing sheets is small, a lower surface of the step portion 34 latches onto the end portion of the stack of the printing sheets in such a manner that the stopper 48 pushes the stack of the printing sheets toward the ejection port 26.

Figure 19:
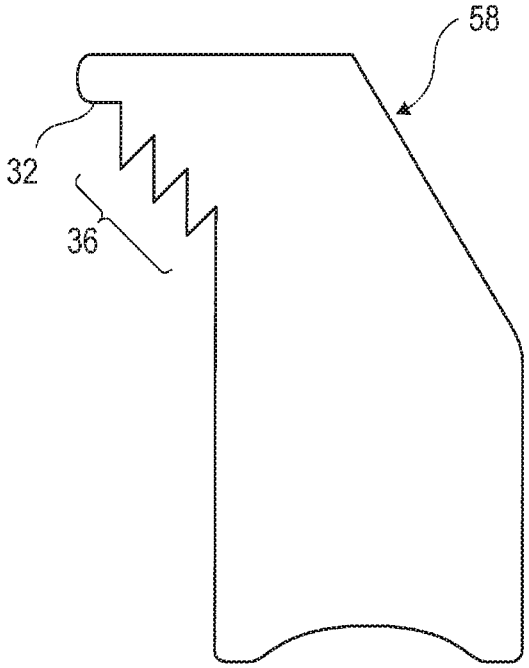
FIG. 19 is a diagram illustrating another modification of the stoppers.

As illustrated in FIG. 19, a stopper 58 according to the other modification includes the step portion 36, which is included in each of the above-described stoppers 28 and which has a sawtooth shape or a substantially sawtooth shape, and the step portion 36 is formed in such a manner as to be inclined.

Modifications

In the above-described exemplary embodiment, although a case has been described in which the present invention is applied to a post-processing apparatus that is configured to be installed onto a printer, the present invention is not limited to such a post-processing apparatus and may also be applied to post-processing apparatuses each having any structure for performing post-processing on a sheet on which a printing operation has been performed.

In addition, in the above-described exemplary embodiment, although a configuration has been described in which a stopper is detachable from an ejection belt, the present invention is not limited to this configuration, and a stopper and an ejection belt may be integrally formed into one member.

Furthermore, in the above-described exemplary embodiment, although a configuration has been described in which two stoppers are mounted on one ejection belt, the present invention is not limited to this configuration, and an ejection belt may be provided with at least one stopper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a storing unit in which a plurality of recording media are stored for performing postprocessing; and a pushing member that latches onto and pushes trailing ends of the recording media stored in the storing unit toward an ejection port, wherein the pushing member includes a first hook portion that latches onto the trailing ends of a first number of the recording media stacked on the storing unit and a second hook portion having a step portion and a substantially straight portion that both latch onto the trailing ends of a second number of the recording media stacked on the storing unit, the second number being smaller than the first number, wherein the step portion has a substantially sawtooth shape with a plurality of teeth and the substantially straight portion extends from a part of the sawtooth shape located farthest from the first hook portion, the pushing member includes a belt member that is stretched between a pair of rotary members and the first hook portion and the second hook portion are mounted on the belt member to latch onto the trailing ends of the recording media, and wherein the step portion is formed in such a manner as to be inclined with respect to the recording media stored in the storing unit and respect to the belt member.

2. The post-processing apparatus according to claim 1, wherein the pushing member includes a hook-member body and a connecting member that is connected to the hook-member body, and wherein the hook-member body and the connecting member are connected to each other while being mounted on the belt member.

3. The post-processing apparatus according to claim 2, wherein a curve-absorbing portion that absorbs curve of the belt member is formed between the hook-member body and the connecting member when the hook-member body and the connecting member are mounted on the belt member, wherein the curve-absorbing portion comprises a portion of the pushing member configured to separate from the belt member to form a space between pushing member and the belt member when the belt member is bent.

4. The post-processing apparatus according to claim 1, further comprising an end guide configured to align a trailing end of the recording media stacked on the storing unit.

* * * * *